US005603462A

United States Patent [19]

Conrad et al.

[11] Patent Number: 5,603,462

[45] Date of Patent: Feb. 18, 1997

[54] CHANGING THREADS IN A SEWING MACHINE

[75] Inventors: Daniel J. Conrad; Luther Stoddard, both of Longmont; Michael G. Weir, Golden; Samuel Padgett, Denver; Dean Pearson, Arvada; Karl Kott, Como, all of Colo.; Kurt L. Bolldorf, Kaiserslautem, Germany

[73] Assignee: Melco Industries, Inc., Denver, Colo.

[21] Appl. No.: 118,922

[22] Filed: Sep. 9, 1993

[51] Int. Cl.[6] ..... B65H 69/04; B65H 57/00; B65H 20/24; D05B 47/00

[52] U.S. Cl. ..... 242/35.6 R; 112/254; 112/302; 57/22; 226/110; 242/147 M

[58] Field of Search ..... 242/147 M, 149, 242/155 M, 128, 556, 554.2, 35.6 R, 419.5, 155 R; 226/110, 116; 57/22, 263; 112/302, 254, 285, 170

[56] References Cited

U.S. PATENT DOCUMENTS

| | | | |
|---|---|---|---|
| 1,459,763 | 6/1923 | Brown et al. | 242/128 |
| 1,571,925 | 2/1926 | Abbott | 242/35.6 R |
| 3,067,704 | 12/1962 | Pedersen | 112/302 |
| 3,262,648 | 7/1966 | Livingston | 242/35.6 R |
| 3,892,432 | 7/1975 | Ingus | 242/35.6 R |
| 4,292,796 | 10/1981 | Mima . | |
| 4,462,557 | 7/1984 | Warner | 242/147 M |
| 4,538,407 | 9/1985 | Matsui et al. | 57/22 |
| 4,579,615 | 4/1986 | Hanyu et al. . | |
| 4,793,273 | 12/1988 | Hara et al. | 112/254 |
| 4,844,358 | 7/1989 | Kamp | 242/35.6 R |
| 4,938,013 | 7/1990 | Zumfeld . | |
| 4,967,679 | 11/1990 | Hara et al. | 112/302 X |
| 5,033,400 | 7/1991 | Fischer | 112/254 |
| 5,188,304 | 2/1993 | Colli et al. | 242/35.6 R |
| 5,269,244 | 12/1993 | Cataletto | 112/302 |
| 5,280,698 | 1/1994 | Gerstner-Stevens et al. | 57/22 |

FOREIGN PATENT DOCUMENTS

| | | | |
|---|---|---|---|
| 0517045A1 | 12/1992 | European Pat. Off. . | |
| 3057094 | 3/1988 | Japan | 112/302 |
| 3059993 | 3/1988 | Japan | 112/302 |
| 546893 | 8/1942 | United Kingdom | 242/128 |
| WO91/04217 | 4/1991 | WIPO . | |

*Primary Examiner*—Michael R. Mansen
*Attorney, Agent, or Firm*—Sheridan Ross & McIntosh

[57] ABSTRACT

A sewing machine is provided for splicing together two different threads. The machine includes a thread tree with a number of thread spools with each thread thereof being inserted through flexible plastic tubing. A movable carriage assembly locates the new thread to be spliced relative to a splicing device passageway that receives the new thread to be spliced along with the old thread. The splicing device includes a front air inlet for drawing the new thread into the passageway of the splicing device and a rear air inlet for creating air turbulence during the splicing operation. Also used in moving the new thread through the passageway is an insertion drive roller connected to a pivotal rocker. A thread clamp cover connected to the rocker cooperates with the trimmer blades to trim the old thread. A thread clamp and a thread clamp magnet cooperate to hold the old thread in a desired position during the insertion of the new thread into the splicing device. A tensioning assembly is able to adjust new thread tension based on a desired tension for the new thread.

42 Claims, 7 Drawing Sheets

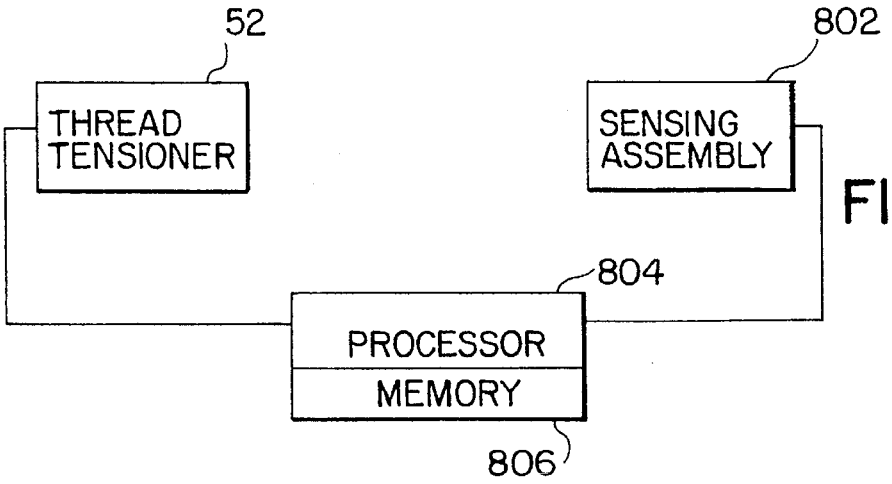
FIG. 8
FIG. 7
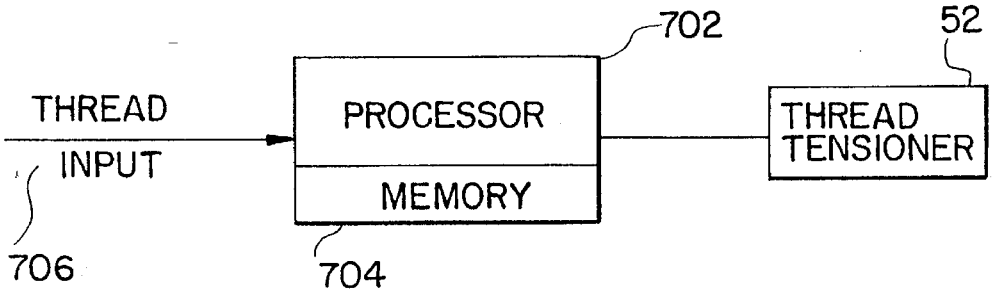

CHANGING THREADS IN A SEWING MACHINE

FIELD OF THE INVENTION

The present invention relates to sewing machines and, in particular, to a stitching apparatus and method for splicing threads.

BACKGROUND OF THE INVENTION

In connection with the sewing of designs and other patterns on work pieces such as garments or cloth, it is often desired to use threads of various types and colors in the sewing or embroidery of a given design. When a sewing or embroidery machine is used, the thread used may be changed by manually removing a thread and rethreading the machine with another thread. Another method of providing for numerous threads is to employ a machine which uses a number of needles and associated mechanisms, each of which is threaded with a different thread. In such a system, availability of a large number of threads requires a complex machine having separate needle assemblies for each type of thread in use. As the desired number of threads increases, the complexity and cost of the machine necessarily increases.

In machines having a single needle, threads may be changed by splicing the first thread to a second thread in a manner which enables the splice to be drawn through the eye of the needle, effectively threading the needle with the second thread. It is known that a splice may be formed by placing the two threads to be spliced in close proximity to each other and subjecting the threads to a jet of air at relatively high velocity. The jet of air causes a portion of the fibers of the threads to interlace along a region of both threads. The interlacing of the fibers is intended to form a splice of sufficient strength and desired size such that the spliced portion can readily pass through the eye of the needle.

Although it is known to use an air jet to splice two threads, it would be advantageous to provide a sewing machine with an integrated thread changing capability for effectively and efficiently handling all weights and types of threads. Such a capability should be provided in a cost effective manner of both construction and operation. It would also be desirable to provide such a machine with the capability of selecting from a large number of thread types and colors by providing an efficient mechanism for the supply of such threads. Such a machine having thread changing capability would also desirably include the feature of being able to adjust the tension of the threads for most effective sewing. It would also be advantageous to expeditiously and efficiently select new threads and to execute a thread change which wastes the minimum amount of thread. A further advantage would be to have the thread selection, thread changing, and tension adjustment be accomplished under programmable control.

SUMMARY OF THE INVENTION

A sewing apparatus is adapted to automatically select and change a large number of different threads. As used herein, "sewing" refers to and includes embroidery, stitching, knitting, chenille and other related operations. The apparatus includes an assembly for splicing two threads by the application of a stream of air to a chamber containing the two threads. The apparatus also includes a mechanism for trimming the original thread, selecting a desired new thread, inserting the new thread into the splicing chamber, and drawing the spliced threads through the eye of a sewing needle.

The apparatus includes a framework on which assemblies and components of the present invention are mounted or supported. The thread splicing assembly is contained in a manifold located on the top of the framework. The manifold may include multiple parts or be a unitary piece. The manifold is pierced by a splice cell or device, which is a passage through the manifold having various cross-section configurations. One area of the splice cell is the splice chamber, where an air jet may be directed at threads passing through the chamber. Another portion of the splice cell forms a vacuum generator, a configuration which causes a pressure differential to develop within the splice cell when compressed air is supplied to that portion of the splice cell. The manifold is also adapted to route compressed air used in the thread change operation as well as to serve as a heat sink and as a mount for other components of the apparatus.

During sewing operations prior to a thread change, the thread select carriage is positioned so that the thread in use is aligned with the centerline of the splice cell, and the thread in use passes freely through the splice cell. The thread also passes through an adjustable thread tensioner before passing through the needle. The thread tensioner may be adjusted in response to signals from a control unit, and may be adapted to automatically adjust the tension applied to a thread in response to a sensing device which indicates tension of the thread.

A large number of spools or cones of thread in a variety of various sizes, types and colors may be mounted on the thread tree, which is mounted on rear of the framework. The thread tree contains spool mounts which are connected to the thread select carriage by flexible plastic tubes. A thread may be fed from a mounted spool through the center tube of the spool mount and through the plastic tube to the thread select carriage mounted on top of the framework. The thread select carriage is adapted to receive numerous plastic tubes and is capable of holding their corresponding threads in a horizontal array, each thread being substantially parallel to the other in the area of the carriage. A pretensioning device is mounted on the thread select carriage to hold a number of threads in desired positions and to assist in the trimming of an old thread, that is to be spliced with a new thread, by maintaining a desired thread tension.

The thread select carriage may be moved laterally to position a desired thread section in the carriage with respect to the thread path through the splice cell. The movement of the thread select carriage is controlled by the control unit, which may contain digital circuitry capable of being programmed to select threads in a specific order to supply the threads needed to produce a given design. In one embodiment, the apparatus is adapted to be connected to an independent computer controller or system which enables the user to utilize the apparatus in embroidering a number of design patterns as well as characters including letters, although it should be understood that the apparatus can also be operatively connected to other types of sewing apparatuses. The control unit may function as a separate unit or integral part of the machine.

When it is desired to change the thread in use, a lower portion of thread which has passed through the needle is trimmed and the trimmed end is inserted into the draw-off mechanism, which includes two parallel rollers capable of pulling thread from the spool, through the machine and then through the eye of the needle. After the lower portion is trimmed and inserted into the draw-off mechanism, the thread select carriage is moved laterally to pull an upper portion of the thread against the side of the splice cell. A portion of the thread between the splice cell and the thread select carriage is then held by a magnetic clamp. The portion of the thread between the clamp and the thread select carriage is severed by pushing the thread down over an oscillating set of trimmer blades. The clamping of the thread in the position against the side of the splice cell provides access through the center of the splice cell for the insertion of a new thread.

The desired new thread is selected by moving the thread select carriage to align the new thread with the centerline of the splice cell. To insert the new thread through the splice cell, compressed air is supplied to the vacuum generator, creating a pressure differential which tends to draw the loose end of the new thread through the splice cell. A pair of rollers engages the thread in the area of the thread select carriage and pushes the thread a metered distance toward the splice cell, causing the loose end of the new thread to be drawn through the splice cell.

After the new thread has been inserted all the way through the splice cell, the compressed air and drive rollers are turned off and a portion of both old and new threads are held by another pair of rollers at the front of the splice cell. The magnetic clamp previously holding the free end of the trimmed old thread is released, allowing the portion of the old thread which passes through the splice cell to move freely. It has been found that having one thread loose during the splicing operation creates superior splices. The threads are spliced by applying a jet of compressed air to the two threads in the splice chamber, generating a turbulent flow of air over the two threads. While the air jet is being applied to the threads, in one embodiment, the forward pair of rollers are actuated so that both threads are moved backward and then pulled forward through the splice chamber, causing the fibers of the threads to become substantially interlaced in the section exposed to the air jet. It has been found that the back and forth motion of the threads during splicing promotes the separation and subsequent interlacing of the fibers of the threads, although such a backward movement of the threads is not required to achieve a suitable splice. After splicing, the compressed air is turned off and the thread is pulled through the needle by the rollers in the draw-off mechanism, effectively threading the new thread through the eye of the needle. The spliced portion of the threads is then trimmed and the excess disposed of in an appropriate receptacle prior to beginning sewing with the new thread.

Based on the foregoing summary, a number of salient features of the present invention are readily discerned. The use of the thread tree and the spool mounts with the center tube enables the initial threading of a given thread to be assisted by the use of compressed air. To insert such a thread, the end of the thread may be placed in the center tube of the spool mount and compressed air applied to the open end, blowing the thread through the plastic tube to the thread select carriage.

For each spool mount, there is a separate plastic tube to conduct the thread to the thread select carriage. This design allows for the capacity of the machine to be easily increased by increasing the number of spool mounts, while the use of flexible plastic tubes to guide the threads to the thread changing mechanism allows for variety and flexibility in the positioning of the spool mounts, avoiding the difficulties and mechanical complexity which may result from multiple free runs of thread through the air in close proximity to each other.

The use of a pretensioning device in the area of the thread select carriage maintains a constant relationship between the various threads in the carriage and prevents the threads from withdrawing back towards the spool. The adjustable tensioner permits a variety of thread types to be used, while providing the optimal thread tension for sewing using each thread.

In one embodiment, although the splice cell can be formed of a number of properly configured and arranged parts the use of a single manifold to form a unitary splice cell incorporating the splice chamber, air jet and vacuum generator is intended to facilitate cost effective manufacture and reduce the possibility of mismatched surfaces in the path of the airflow through the splice cell. A smooth flow of air through the splice cell increases the efficiency of the thread insertion cycle and the lack of mismatched surfaces in the thread path reduces the possibility of a thread becoming snagged inside the machine.

The vacuum generator and the drive rollers used to insert a new thread during a thread change cycle may also be used to facilitate the initial threading of the machine with the first thread to be used.

The use of a programmable control unit permits the thread change capability to be integrated into programs which control the operation of the machine to create programmed designs, allowing a machine to complete a multicolor or multithread design without operator intervention.

The magnetic clamp and trimmer components allow a thread to be trimmed close to the splice cell, permitting the advantages of having one end of a thread free during splicing, while providing a means to hold the old thread out of the path of the new thread while the new thread is being inserted.

Additional advantages of the present invention will become readily apparent from the following discussion, particularly when taken in conjunction with the accompanying drawings.

FIGS. *6a–6i* are schematic representations associated with the steps of the thread change process;

FIG. 7 is a block diagram illustrating the control of the thread tensioner; and FIG. 8 is a block diagram illustrating the control of the thread tensioner in response to signals from a sensing unit.

DETAILED DESCRIPTION

Figure 1:
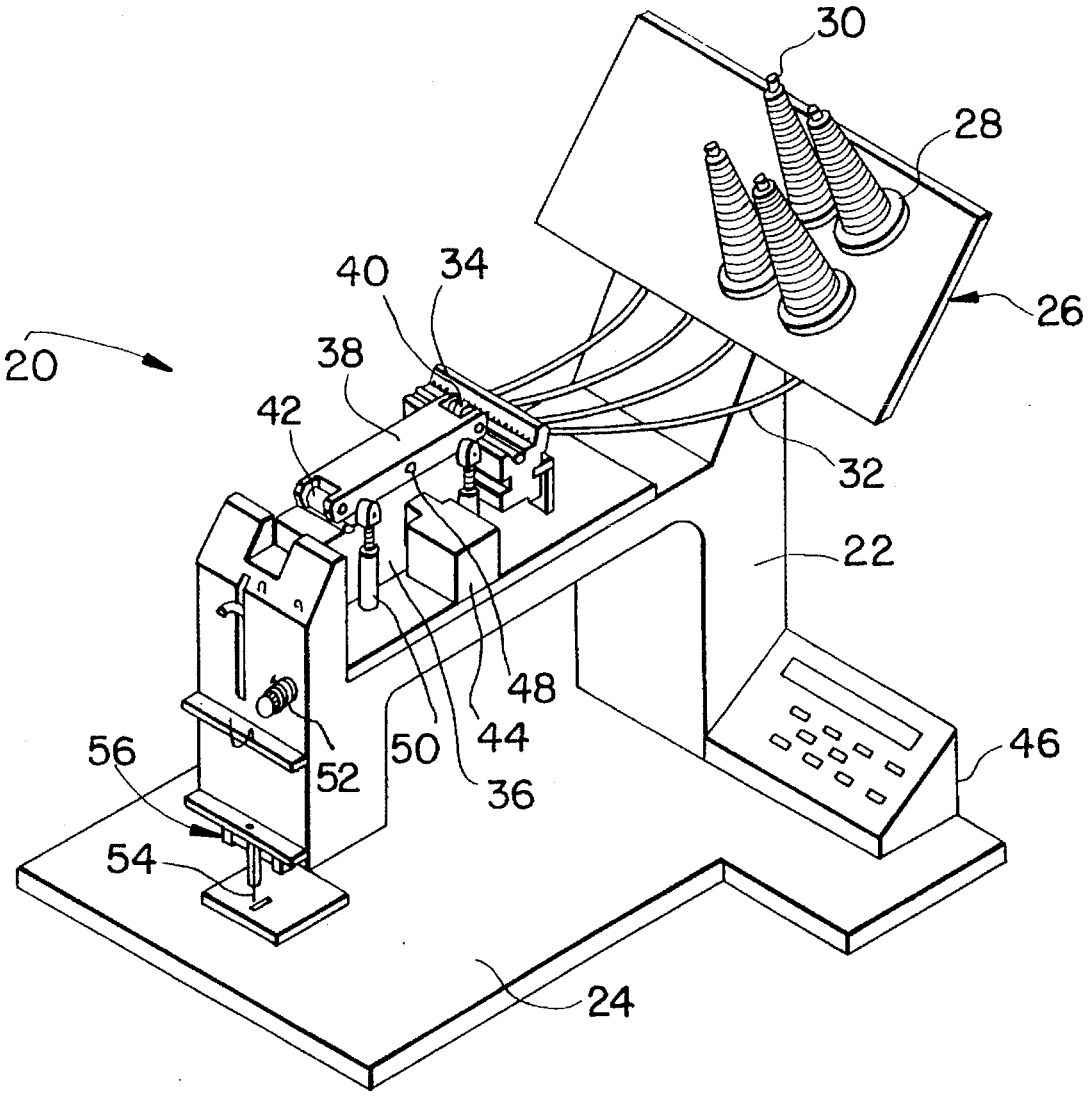
FIG. 1 is a perspective view of a sewing machine equipped with multiple thread spools and thread changing mechanism.
Figure 2:
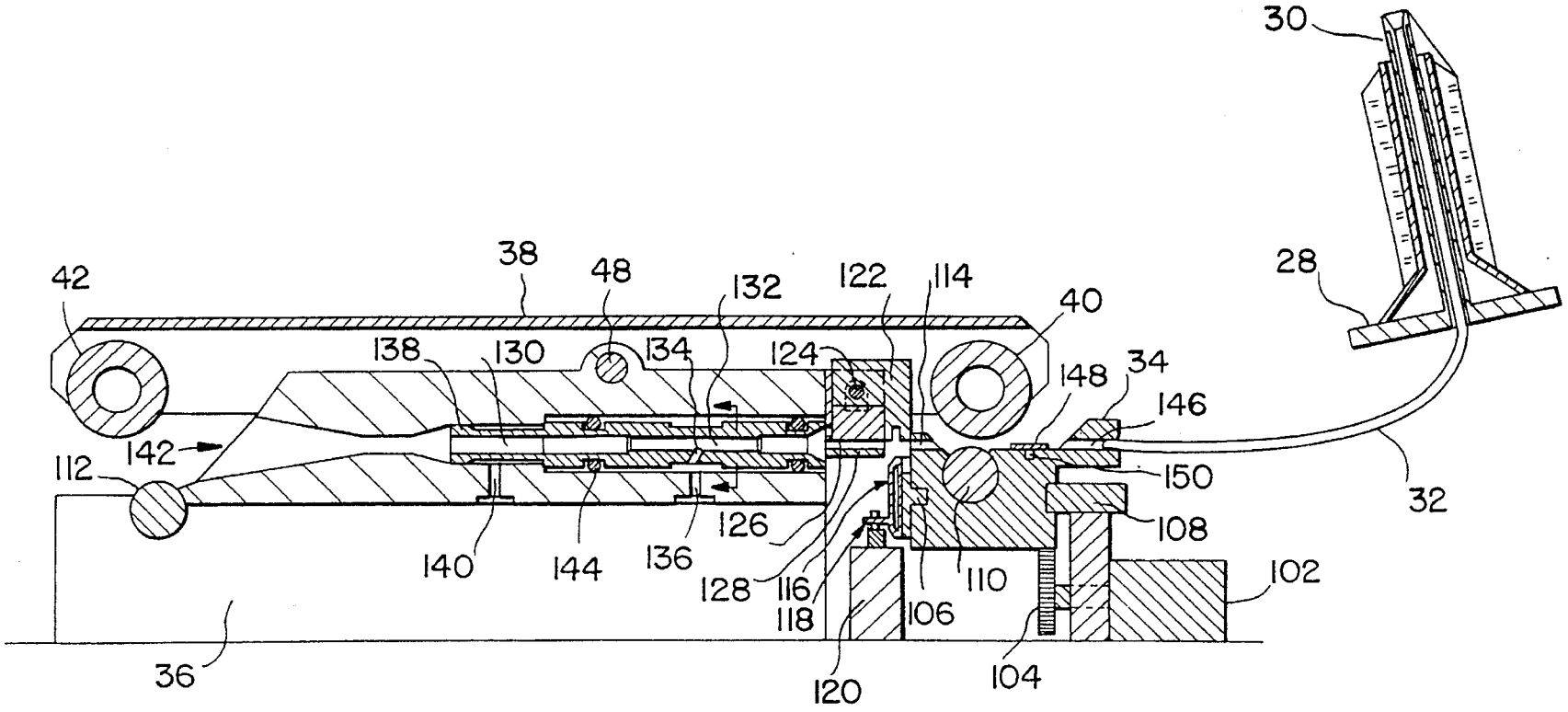
FIG. 2 is a fragmentary, lateral section of the top portion of the machine showing the thread selection and splicing mechanisms.

In accordance with the present invention, a sewing apparatus is provided for sewing using multiple threads. With reference to FIG. 1, the apparatus 20 includes a framework 22 that is affixed to a base 24 which provides a working surface for the work piece. Mounted on the framework is a thread tree 26 which may contain numerous spool mounts 28 for the mounting of various sized spools and cones of thread. The spool mount 28 includes a center tube 30 which passes through the center of the spool and is connected to one end of a flexible plastic tube 32. The other end of the flexible plastic tube 32 is connected to a thread select carriage 34 located on the top of the framework. The thread select carriage 34 has a plurality of openings disposed laterally along the rear of the thread select carriage, each adapted to accept a flexible plastic tube 32. The capacity of the thread tree may be expanded by the addition of additional spool mounts, thus providing for multiple types and colors of spools and cones of thread. Forward of the thread select carriage 34 is a manifold 36. Mounted on the upper part of the manifold is a rocker 38, upon which are mounted two drive rollers, namely the thread insertion drive roller 40 and the thread advance drive roller 42. The drive rollers are driven through a system of belts and pulleys (not shown) connected to a drive motor 44 which is controlled by the control unit 46. The rocker may rotate through a limited arc about pivot 48 in response to the actuation of air cylinders 50 under the control of the control unit 46. A thread tensioner 52 and the needle 54 are mounted on the forward face of the framework 22. Immediately to the rear of the embroidery needle is the draw-off mechanism 56.

With reference particularly to FIGS. 2–5, the mechanical assemblies and their components for accomplishing a thread change operation are illustrated. The thread select carriage 34 may be moved back and forth laterally by operation of the selector drive motor 102 which is controlled by the control unit 46. The selector drive motor 102 turns the selector drive gear 104 which engages a rack on the bottom of the thread select carriage 34. The path of the thread select carriage is constrained by the front guide rail 106 and the rear guide rail 108 which are fixed with respect to the framework 22.

The manifold 36 is positioned on the top of the framework forward of the thread select carriage. Above the manifold 36 is the rocker 38 which may rotate about the pivot 48. The rocker has three main positions. In the neutral rocker position, shown in FIG. 2, the rocker is substantially horizontal. In the first rocker position, FIG. 4, the air cylinders 50 are actuated so as to move the rear of the rocker 38 towards the base 24, causing the thread insertion drive roller 40 to move into contact with the thread insertion idler 110 rotatably mounted on the thread select carriage 34. In the second rocker position, the air cylinders 50 are actuated so as to move the front of the rocker 38 towards the base 24, causing the thread advance drive roller 42 to move into contact with the thread advance idler 112 rotatably mounted on the forward portion of the manifold 36.

The thread trimmer is located forward of the forward edge of the thread select carriage 34, which includes coaxial holes 114. The thread trimmer includes two parallel trimmer blades 116, one of which is fixed and the other of which is movable. The movable trimmer blade is driven by an eccentric 118 connected to the drive shaft of the trimmer motor 120. The eccentric 118 passes through a flange of the movable trimmer blade, causing the trimmer blade to oscillate laterally when the trimmer motor 120 is activated. The trimmer blades 116 have two cutting areas located laterally on either side of the centerline of the splice cell 130.

Above the trimmer blades 116 is the thread clamp cover 122 which is rotatably connected to the rocker 38 by a shaft 124. When the rocker 38 is moved to the first rocker position, the thread clamp cover 122 correspondingly moves down, causing the thread clamp cover 122 to move down over the trimmer blades 116. A portion of the lower edge of the thread clamp cover 122 contains a cutout located so as to permit a thread which is substantially in line with the center line of the splice cell 130 to pass freely through the thread clamp cover 122 when the rocker 38 is in either the first or neutral positions. The lower edges of the thread clamp cover 122 on either side of the cutout are located above the cutting area of the trimmer blades 116. The shaft 124 also passes through vertical slots in the thread clamp 126. The thread clamp 126 is made of ferromagnetic material and is located between the thread clamp cover 122 and the manifold 36. A portion of the bottom of the thread clamp 126 contains a cutout located so as to permit a thread which is substantially in line with the center line of the splice cell 130 to pass freely through the thread clamp 126 when the rocker 38 is in either the first or neutral positions. A clamp magnet 128 is located directly below the thread clamp 126. When the rocker 38 is in the neutral position, the magnetic attraction between the clamp magnet 128 and the thread clamp 126 causes the thread clamp 126 to restrain the movement of a thread passing between a bottom surface of the thread clamp 126 and the clamp magnet 128. When the rocker 38 is moved to the first rocker position, the thread clamp 126 remains engaged, the shaft 124 moving downward through the vertical slot. When the rocker 38 is moved to the second rocker position, the shaft 124 moves upward in the vertical slot until it contacts the top of the vertical slot, thereafter continuing upward and causing the thread clamp 126 to correspondingly move upwards away from the clamp magnet 128.

Figure 5:
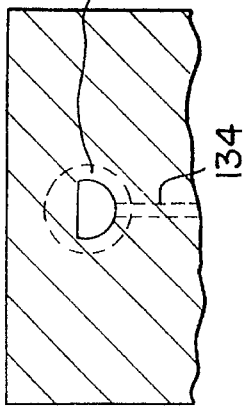
FIG. 5 is a fragmentary, cross-section of the splice chamber.
Figure 4:
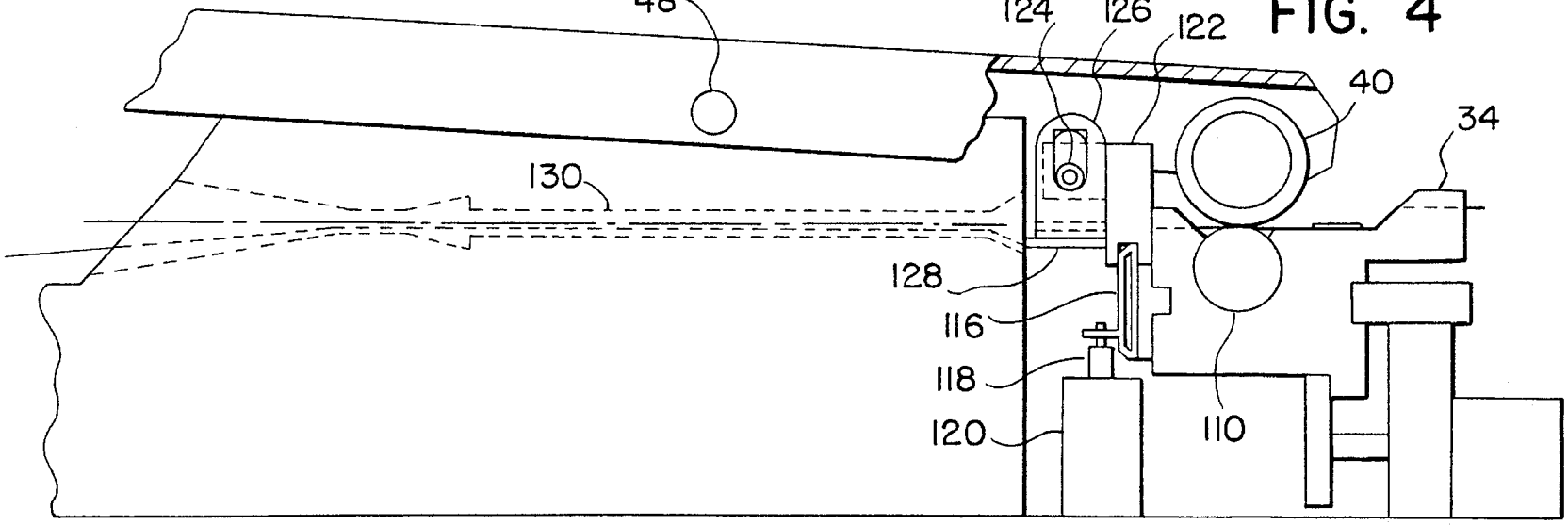
FIG. 4 is a partial cutaway view showing the rocker in the first rocker position with the thread clamp engaged.

Forward of the thread clamp 126 is the rear opening of the splice cell 130. The splice cell 130 has a passageway with various cross-sections passing substantially horizontally through the manifold 36. Toward the rear of the splice cell 130 is the splice chamber 132. The splice chamber 132 has a cross-section with a flat top forming a horizontal chord, as shown in FIG. 5. Returning to FIG. 2, the bottom of the splice chamber 132 is intersected by the splice jet tube 134, a cylindrical hole which is positioned at an approximately 15° angle from vertical. The splice jet tube 134 is pneumatically coupled to the rear air inlet 136, which allows compressed air to be applied to the splice chamber 132 through the splice jet tube 134. Forward of the splice chamber 132 is the vacuum generator 138, a shaped venturi which is pneumatically coupled to the front air inlet 140. The configuration of the vacuum generator is such that when compressed air is applied to the front air inlet 140, the flow of the compressed air within the splice cell 130 over the vacuum generator 138 towards the exhaust 142 creates a pressure differential in the splice cell 130. The front air inlet 140 is pneumatically isolated from the rear air inlet 136 by O-ring seals 144. Even though an integral, one-piece splice cell is disclosed, it should be understood that the splice cell is able to be formed using multiple parts that are properly arranged and interconnected and such an embodiment is practical when the manufacture of a single piece unit is not practically feasible.

Figure 3:
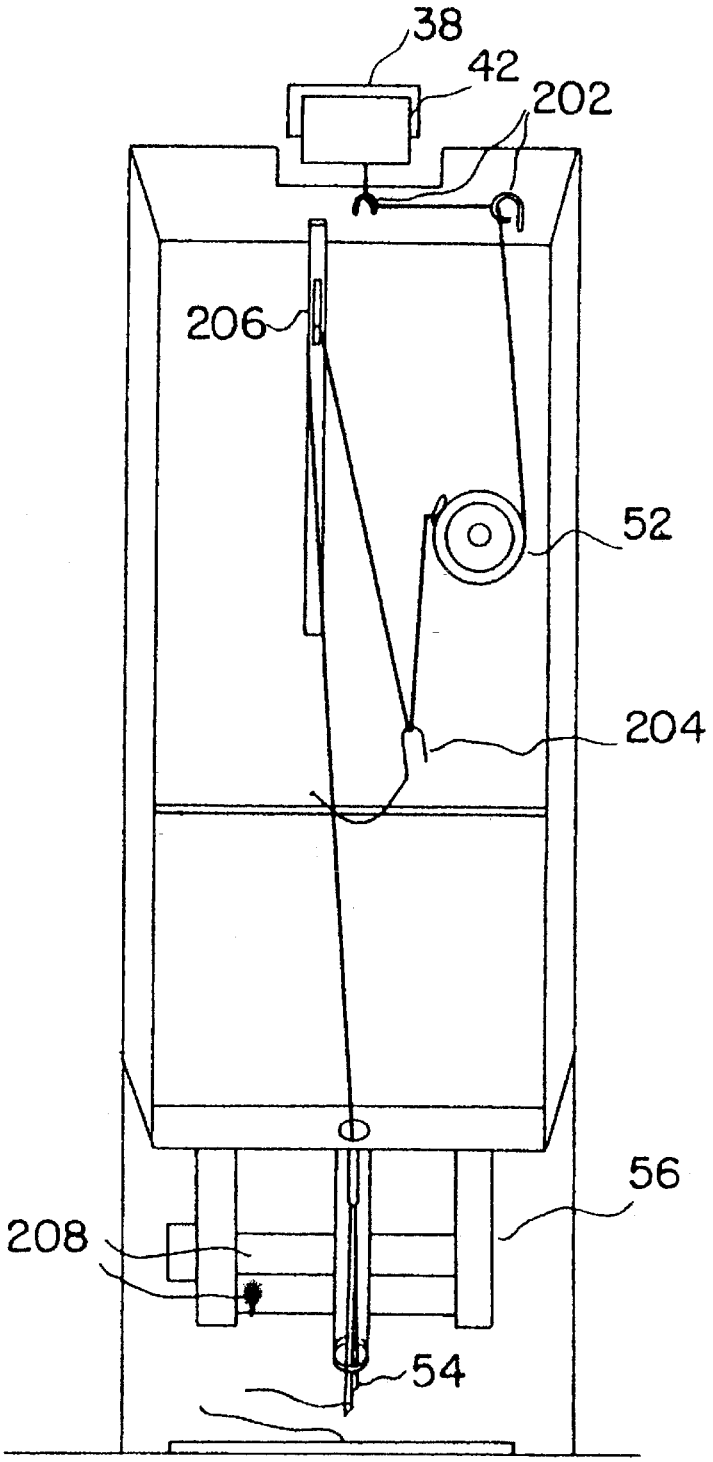
FIG. 3 is a front elevation of the machine showing the thread tensioner and thread draw-off mechanisms.

The path of a thread through the machine during sewing operations is now described. Thread from a spool mounted on the thread tree 26 passes through the center tube 30 of the spool mount 28, through a flexible plastic tube 32 and through the rear thread hole 146 which is formed through the rear of the thread select carriage 34. After passing through the rear thread hole 146, the thread is passed through a pretensioner device 148. In a preferred embodiment, the pretensioner device may include a plate of ferromagnetic material which is attracted to a pretensioner magnet 150 embedded in the thread select carriage 34, wherein the magnetic force attracting the plate to the magnet causes the plate to apply friction to the thread passing between them to maintain the thread in tension. After passing through the pretensioner device 148, the thread passes over the thread insertion idler 110 and then through the coaxial hole 114 through the front edge of the thread select carriage 34 which is substantially in line with the center line of the rear thread hole 146. When a thread is in use in the sewing process, the thread select carriage 34 is positioned to locate the coaxial hole 114 which corresponds to the thread which is in use in line with the centerline of the splice cell 130. The rocker 38 is in the neutral position and the thread passes between the thread insertion drive roller 40 and the thread insertion idler 110 without contacting the thread insertion drive roller 40. The thread passes above the trimmer blades 116, and through cutouts in the thread clamp cover 122 and in the thread clamp 126. The thread then passes through the splice cell 130. After exiting the splice cell, the thread passes between the thread advance drive roller 42 and the thread advance idler 112 without contacting the thread advance drive roller 42. With reference to FIG. 3, the thread next passes through the thread direction guides 202, the thread tensioner 52, thread guide 204, take-up lever 206 and needle 54.

The thread direction guides 202 and the thread tensioner 52 are mounted on the forward end of the framework. The thread tensioner 52 includes two adjacent surfaces which the thread may pass between. By adjusting the position of the adjacent surfaces, the tension on a thread may be adjusted. The tension of a thread may be adjusted or released by movement of a surface of the thread tensioner 52 in response to signals from the control unit 46. Such movement may be caused by a variety of means, including electrical, mechanical, pneumatic and hydraulic actuators.

With reference to FIG. 7, the control unit 46 may include a processor 702 and memory 704. Thread input 706 reflects a desired value relating to the tension of a given thread which is input to the processor 702 and stored in memory 704 in a location corresponding to that thread. Thread input 706 may be input by the operator or input as part of a control program. When it is desired to adjust the tension of the thread, the processor 702 retrieves the value of the thread input 706 from memory 704 and transmits a signal to the thread tensioner 52 to adjust the tension a desired amount. With reference to FIG. 8, in another embodiment, a sensing assembly 802 for detecting thread tension is attached in a suitable location adjacent to the thread path. Signals from the sensing assembly 802 are transmitted to the control unit 46, allowing adjustment of the thread tensioner 52 in response to variations in thread tension measured by the sensing assembly 802. In one embodiment, the thread tensioner 52 includes an actuator that is activatable to compress a spring with the force produced thereby applied to at least one disk or other member for engaging the thread and applying pressure thereto. The control unit 46 may include a processor 804 and memory 806. Desired values for thread tension of each thread may be stored in a location in memory 806 corresponding to that thread. The processor 804 receives a signal from the sensing assembly 802, which is compared to the desired value for that thread stored in memory 806. If the comparison indicates a difference between the actual signal and the desired value, the processor 804 transmits a signal to the thread tensioner 52 to adjust the tension to compensate for the deviation from the desired value. In some applications, it may be desirable to limit the number of signals to the thread tensioner 52. The number of signals may be limited by establishing a reference level of deviation. After calculating the difference between the actual signal and the desired value, the processor 804 may compare the difference with the reference level and would not send a signal to the thread tensioner 52 unless the difference exceeded the reference level. A limitation on the number of signals sent may decrease the mechanical wear on the thread tensioner 52 that might result from a continuous stream of signals. It may be appreciated that this embodiment permits substantially continuous measurement and adjustment of the thread tension, or, alternatively, measurement and adjustment of the tension at selected intervals controlled by a another input. Relatedly, there are time intervals during the cycle of the formation of a single stitch when it is advantageous to control the tightness or looseness of the thread. Generally, a mechanically driven sewing machine head has predetermined timing cycles during which the thread is controlled to provide certain functions and results. During a timing cycle, at predetermined intervals, tension related information or data is supplied for regulating thread tension. For example, during a first interval or increment of the cycle, the thread tension is controlled to have a first value and, during a second interval, the thread tension has a second value. Alternatively, a sensor for providing tension related feedback information or data is utilized. The sensor detects., at all instances of time, during the cycle the actual thread tension. This actual value is compared to a predetermined value that is the desired tension for that particular interval of the cycle. If the desired and actual tensions do not match or substantially correspond, the thread tension is adjusted to correspond to the desired tension. In one embodiment, thread tension is regulated using a voice coil controlled using a processor output.

Returning to FIG. 3, the draw-off mechanism 56 includes two parallel rollers 208 and a retractable hook (not shown), which when extended can grab a loose thread, and, upon retraction, pull the thread back through the rollers 208. Also connected to the draw-off mechanism 56 is a tube (not shown) to which vacuum may be supplied, causing loose threads drawn through the draw-off mechanism 56 to be sucked through the tube and deposited into an appropriate receptacle.

The operation of the thread clamp 126 and the thread clamp cover 122 may be further described by reference to the movement of the rocker 38. It should be appreciated that the path of a thread which is aligned with the centerline of the splice cell 130 is not impeded by either the thread clamp 126 or the thread clamp cover 122, regardless of the rocker position. While sewing is taking place, the rocker 38 is in the neutral position. Although the thread clamp 126 is engaged by clamp magnet 128 in the neutral rocker position, the thread in use is located substantially in line with the centerline of the splice cell and therefore passes freely through the cutout in the center of the thread clamp 126. Similarly, the thread passes freely under the thread clamp cover 122. If the rocker 38 is moved to the first rocker position, the thread may continue to pass through the cutout in the thread clamp 126 and now passes through the cutout in the thread clamp cover 122, which is moved down with the rocker. If the rocker 38 is moved to the second rocker position, both the thread clamp 126 and the thread clamp cover 122 are raised by the rocker 38 above the path of the thread, disengaging thread clamp 126 from clamp magnet 128. The thread clamp 126 and the thread clamp cover 122 therefore only contact a thread that has been displaced to either side of the centerline of the splice cell 130. In the second rocker position, the bottom of the thread clamp 126 is raised sufficiently above the clamp magnet 128 that a thread which is displaced to either side of the centerline of splice cell 130 may be positioned between the clamp magnet 128 and the bottom of thread clamp 126. Such a lateral displacement will also cause the thread to pass between the lower edge of the thread clamp cover 122 and a cutting area of the trimmer blades 116. If the rocker 38 is then moved to the neutral position, the magnetic attraction of clamp magnet 128 causes the thread clamp 126 to move down to engage the portion of the thread passing under the clamp bottom, thereby restraining the movement of that portion of the thread. While the described embodiment uses magnetic attraction to produce the clamping force, it should be appreciated that mechanical, pneumatic, hydraulic, electrical and spring means might also be used to produce such a force. When the rocker 38 is in the neutral position, the thread clamp cover 122 is not in contact with the thread. If the rocker 38 is moved to the first rocker position, the thread clamp 126 remains engaged and the thread clamp cover 122 moves downward. The downward movement of the thread clamp cover 122 causes the lower edge of the cover to contact a thread which is displaced to one side of the centerline of the splice cell 130, thereby pushing the thread into contact with a cutting portion of the trimmer blades 116 located underneath the thread. As described herein, the thread clamp 126 may be used to hold a portion of a thread both before and after trimming, and might also be used to hold a thread during a splicing operation if desired.

In consideration of the following description of the thread change cycle, it should be appreciated that the order of some of the steps may be varied without significant impact on the result.

Figure 6A:
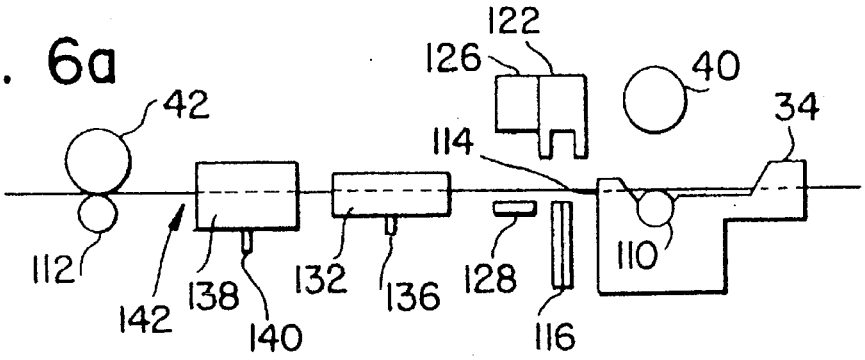

During the sewing process preceding a thread change cycle, the rocker 38 is in the neutral position. The first series of steps of the thread change cycle severs the thread which is then in use (old thread) after it has passed through the needle 54. The first step is to move rocker 38 to the second rocker position, raising the thread clamp 126 away from the clamp magnet 128, FIG. 6*a*. Next, a portion of the old thread which has already passed through the needle is cut by an under-trim device (not shown) mounted in the base 24 and the loose end is drawn into the draw-off mechanism 56 by the thread holder mechanism or hook.

Figure 6B:
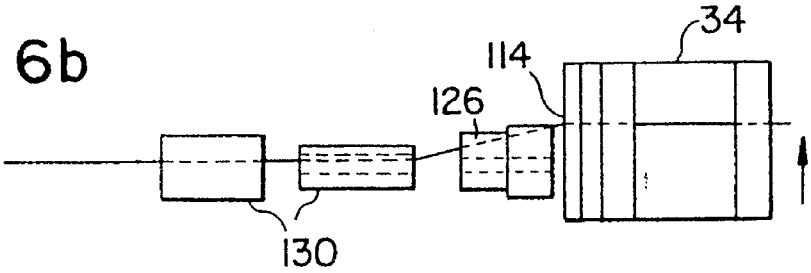

The next step positions the portion of the old thread adjacent to the thread select carriage for trimming, FIG. 6*b*. The thread select carriage 34 is moved laterally to displace the coaxial hole 114 corresponding to the old thread away from the centerline of the splice cell 130. The direction of movement is determined by the relative positions in the thread select carriage 34 of the old thread and the desired new thread. The lateral displacement causes the old thread to be pulled away from the centerline of the splice cell 130 and against the side of the splice cell 130. The displacement also causes the old thread to be drawn under a bottom surface of the thread clamp 126 and over a cutting area of the trimmer blades 116.

Figure 6C:
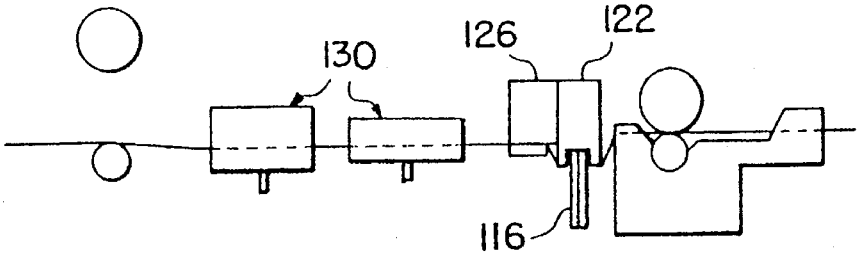

The next series of steps causes the old thread to be trimmed, FIG. 6*c*. The first step is to activate trimmer motor 120, causing the movable trimmer blade to oscillate back and forth. Next, the rocker 38 is moved to the first rocker position. This movement causes the portion of the old thread immediately to the rear of the splice cell 130 to be held by the thread clamp 126. The movement also causes the thread clamp cover 122 to push the portion of the old thread immediately to the rear of the thread clamp 126 into contact with a cutting area of the trimmer blades 116, causing the old thread to be severed by the trimmer.

Figure 6D:
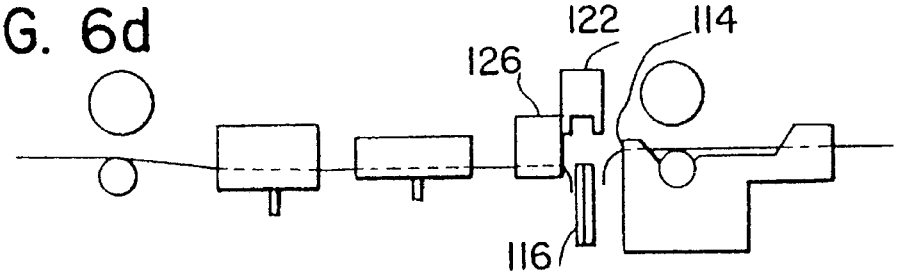
Figure 6E:
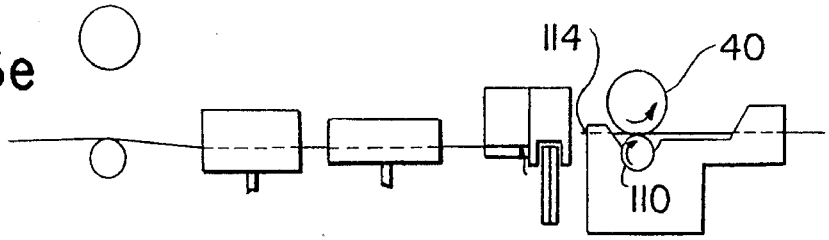

The next series of steps clears the trimmed end of the old thread. The first step is to move rocker 38 to the neutral position, causing the thread clamp cover 122 to lift away from the trimmer blades 116, while the thread clamp 128 continues to hold one end of the old thread, FIG. 6*d*. The thread select carriage 34 is then moved back to its original position where the coaxial hole 114 corresponding to the old thread is aligned with the centerline of the splice cell. Next the trimmer motor 120 is turned off. The rocker 38 is then moved to the first rocker position, causing the thread insertion drive roller 40 and the thread insertion idler 110 to contact the portion of the old thread which is still connected to its spool, FIG. 6*e*. After the trim, the drive motor 44 is then energized to cause the thread insertion roller 40 to rotate in a reverse direction so as to cause the end of the thread which is still connected to the spool to be retracted a short distance away from the trimmer blades 116. This retraction prevents the trimmed end of the old thread which previously extended from the thread select carriage from becoming tangled in the machine during subsequent movement of the thread select carriage. It should be appreciated, however, that it is not necessary to cause this movement of the roller 40. The reverse direction movement enhances the reliability of desired thread positioning, but also requires additional time.

Figure 6F:
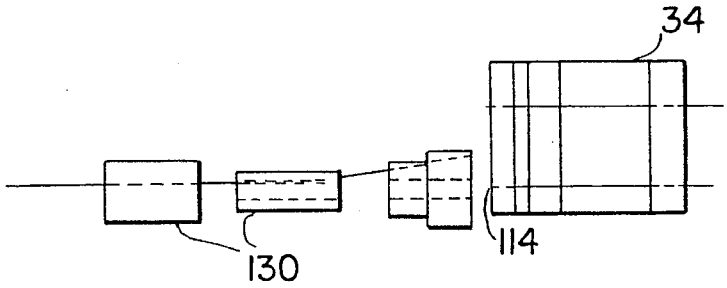

The next series of steps causes the new thread to be selected, FIG. 6*f*. Compressed air is supplied to the front air inlet 140 causing a pressure differential or vacuum in the splice cell 130, which tends to draw the free end of the new thread through the splice cell 130 and out of the exhaust 142 (insertion vacuum). The rocker 38 is moved to the neutral position. Next, the new thread is selected by moving the thread select carriage 34 to the position where the coaxial hole 114 containing the new thread is aligned with the centerline of the splice cell 130. In a preferred embodiment, during the selection of the new thread, the thread select carriage 34 is initially moved approximately 1½ coaxial hole 114 positions (about 0.3 inch) past the aligned location and then returned to the position where the coaxial hole 114 is aligned with the splice cell centerline. This sequence of movement has been found to facilitate the entry of the end of the new thread into the opening through the thread clamp cover by allowing the end of the thread, the position of which may not precisely correspond to the centerline of the coaxial hole 114, to laterally move into a position adjacent to the opening. While the sequence of movement described herein has been found to be functional, other sequences and distances could also be used.

Figure 6G:
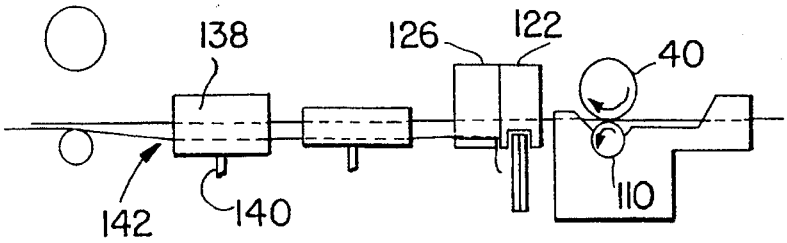
Figure 6H:
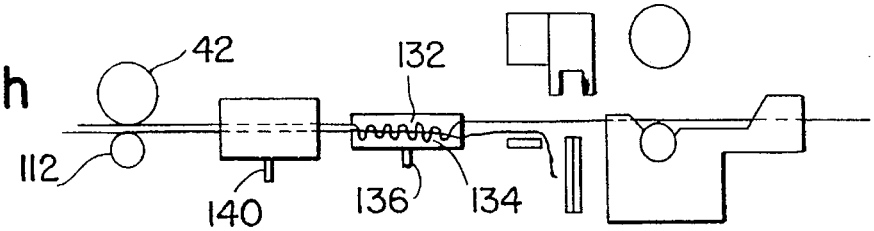
Figure 6I:
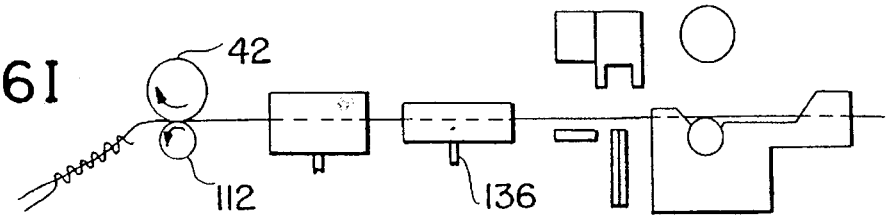

The next series of steps causes the new thread to be inserted, FIG. 6*g*. The first step is to move rocker 38 to the first rocker position, with the insertion vacuum still on, causing the thread insertion drive roller 40 and the thread insertion idler 110 to come into contact with the new thread. The drive motor 44 is then energized to cause the thread insertion drive roller 40 to rotate in a direction so as to cause the free end of the new thread to slowly move forward a metered distance through the cutouts in the thread clamp cover 122 and thread clamp 126 towards the rear opening of the splice cell 130. The operation of the rollers is under the control of the control unit 46. In one embodiment, the rotation of the thread insertion drive roller 40 is controlled to cause approximately one inch of thread to be advanced. While it has been found to be functional to initiate the supply of air prior to initiating the rotation of the drive rollers, it should be appreciated that both actions could also be initiated simultaneously or in the reverse order. The next step is to accelerate drive motor 44 to a higher speed, causing the thread insertion drive roller 40 to advance a metered distance of thread sufficient to permit the free end of the new thread to pass completely through the splice cell 130. In one embodiment, the rotation of the thread insertion drive roller 40 is controlled to cause approximately four inches of thread to be advanced. The pressure differential in the splice cell 130 created by application of compressed air to the vacuum generator 138 in conjunction with the force imparted to the thread by the rotation of the thread insertion drive roller 40 and the thread insertion idler 110 causes the new thread to be inserted through the cutouts in the thread clamp cover 122 and the thread clamp 126, into the splice cell 130, out the exhaust 142 and between the thread advance drive roller 42 and the thread advance idler 112.

The next series of steps clamps the forward portions of both old and new threads, FIG. **6*h*. The first step is to terminate the insertion vacuum and turn the drive motor 44 off. Similarly to the sequence of actuation discussed above, the termination of the insertion vacuum and the rotation of the motor may occur in either sequence, or simultaneously. The next step is to move the rocker 38 to the second rocker position, causing portions of both the old and new threads to be clamped between the thread advance drive roller 42 and the thread advance idler 112. The movement of the rocker 38 to the second rocker position also causes the thread clamp 126 to move away from the clamp magnet 128, releasing the trimmed end of the old thread. Following this step, a portion of the new thread extends through the splice chamber 132 under tension and a portion of the old thread, held by the thread advance drive roller 42 and the thread advance idler 112, also passes through the splice chamber 132**.

The next series of steps causes the threads to be spliced, FIG. **6*h*. The first step is to supply compressed air to the rear air inlet 136, causing a jet of air to pass through the splice jet tube 134 into the splice chamber 132. The angled position of the splice jet tube 134 and the flat configuration of the top of the splice chamber 132 cause the airflow with in the splice chamber 132 to be relatively turbulent. The turbulent air flow over the threads passing through the splice chamber 132 causes the fibers of the threads to tend to separate from their original positions and become intermingled with the fibers of the other thread. While the air jet is flowing through the splice jet tube 134 into the splice chamber 132, the drive motor 44 is energized to cause the thread advance roller 42 to rotate in a direction so as to cause both the new thread and the old thread to move toward the rear of the splice cell 130 approximately one-half inch. The direction of rotation of the drive motor 44 is then reversed to pull both the old thread and new thread forward approximately one and one-half inch. This back and forth movement of the threads through the splice chamber 132** over the air jet causes the fibers of the two threads to be sufficiently intermingled that the spliced area of both threads may be pulled through the eye of the needle by pulling on the first end of the old thread. During the backward movement, the tension on the new thread is reduced and it is believed that this motion promotes the separation of the fibers of the threads and the subsequent intermingling of the fibers. Also, the ability of the portion of the old thread which is in the splice cell to move freely increases the opportunities for the fibers of both threads to come into contact.

The next series of steps causes the new thread to be threaded through the eye of the needle 54, FIG. **6*i*. First, the vacuum draw-off is turned on, the thread tensioner 52 is released and the supply of compressed air to the rear air inlet 136 is turned off. The thread is then advanced by the thread advance drive roller 42 and the draw-off mechanism 56 a sufficient distance to pull the spliced area of both threads through the eye of the needle 54**.

The final series of steps trims and removes the spliced portion. With the vacuum draw-off still on, the first step is to use the under-trim device to trim a portion of the new thread which has been pulled through the eye of the needle 54. This trimming operation severs the thread beyond the spliced portion of the old and new threads from the remainder of the new thread. Next, the spliced portion is drawn through the draw-off mechanism 56 and through the attached vacuum tube into a waste receptacle (not shown). Next, the rocker 38 is moved to the neutral position and the thread tensioner 52 is adjusted to the appropriate tension. The thread holder mechanism is activated to pull the thread out of the material being stitched so that the thread tail will be pulled down into the material when the initial stitches are sewn subsequent to the splicing operation.

What is claimed is:

1. An apparatus for splicing a first thread with a second thread, comprising:

a thread tree having a number of spools with each having a thread and including at least a first spool having a first thread and a second spool having a second thread;

a thread clamp assembly for releasably holding at least one of the first thread and the second thread; a splicing device for splicing the first and second threads together;

a carriage assembly for locating the second thread selected from the number of threads in a desired position relative to said splicing device;

means for moving at least one of the first and second threads relative to said splicing device, said means for moving including a rocker having at least a first roller connected thereto with said rocker being pivotal among a first rocker position, a second rocker position and a neutral position; and a thread trimming device for cutting the first thread;

wherein said thread clamp assembly, said means for moving and said thread trimming device are operatively interconnected to facilitate thread clamping, moving and trimming.

2. An apparatus, as claimed in claim 1, wherein:

said thread tree includes a number of flexible tubes, each of said tubes receiving at least one of the threads.

3. An apparatus, as claimed in claim 1, wherein:

said thread clamp assembly includes a first clamp member and a second clamp member with the first thread being positionable therebetween.

4. An apparatus, as claimed in claim 3, wherein:

said first clamp member includes a thread clamp and said second clamp member includes a thread clamp magnet with a force of said clamp magnet being used to attract said thread clamp to said clamp magnet.

5. An apparatus, as claimed in claim 1, wherein:

said thread clamp assembly includes a thread clamp connected to said rocker for desired movement therewith.

6. An apparatus, as claimed in claim 1, wherein:

said means for moving includes an insertion roller disposed adjacent a first end of said splicing device and an advance roller positioned adjacent to a second end of said splicing device.

7. An apparatus, as claimed in claim 1, wherein:

said thread trimming device includes a thread clamp cover and a blade with said thread clamp cover being movable to position the first thread for cutting by said blade.

8. An apparatus, as claimed in claim 7, wherein:

said means for moving includes a rocker and said thread trimming device includes a thread clamp cover with said thread clamp cover being connected to said rocker and said thread clamp cover being movable with said rocker.

9. An apparatus, as claimed in claim 8, wherein: said thread clamp assembly includes a thread clamp and said thread trimming device includes a shaft that connects said thread clamp cover to said rocker with said thread clamp cover being movable with said rocker while said thread clamp remains substantially stationary.

10. An apparatus, as claimed in claim 1, wherein: said carriage assembly includes a pre-tensioning device.

11. An apparatus, as claimed in claim 1, wherein:

said splicing device is a single, one-piece unit having a passageway with a number of different cross-sections.

12. An apparatus, as claimed in claim 11, wherein:

said splicing device includes a front air inlet for use in creating a pressure differential in said splicing device passageway.

13. An apparatus, as claimed in claim 12, wherein:

said splicing device includes a rear air inlet for supplying air used in providing a splice between the first thread and the second thread with said front and rear inlets being pneumatically isolated from each other.

14. An apparatus, as claimed in claim 1, further including:

a tensioning assembly operatively joined to said splicing device for adjusting the tension of the second thread after splicing between the first thread and the second thread.

15. An apparatus, as claimed in claim 14, wherein:

said tensioning assembly includes a predetermined thread tension value and means for comparing actual tension of the second thread with said predetermined thread tension value for determining whether to adjust the tension of the second thread.

16. An apparatus, as claimed in claim 14, wherein:

said tensioning assembly includes a sensing assembly for detecting tension of the second thread, an output of said sensing assembly being compared with a stored, predetermined value associated with a desired tension of the second thread.

17. An apparatus for splicing a first thread with a second thread, comprising:

a thread tree having a number of thread spools each having a thread and including a first spool having a first thread and a second spool having a second thread;

a thread clamp assembly for releasably holding the first thread;

a carriage assembly for locating the second thread selected from the number of threads in a desired position;

a splicing device for splicing the first and second threads together;

means for moving at least one of the first and second threads relative to said splicing device; and a thread trimming device for cutting the first thread; wherein wherein said means for moving moves the second thread in both a first direction and a second opposite direction during splicing of the first and second threads and said means for moving includes an insertion drive roller and an advance drive roller with each of said drive rollers being movable using a single motor.

18. A method for splicing a first thread with a second thread, comprising:

providing a first thread;

locating a second thread in desired positions relative to a splicing device;

trimming said first thread to provide a end;

causing said second thread to be positioned in a passageway of said splicing device; and splicing said first and second threads together using said splicing device after said trimming step and by supplying air to said splicing device to create a turbulent air flow over said first and second threads, with both of said first and second threads moving in a first direction along lengths of said first and second threads and then moving in a second direction along length of said first and second threads during the time-said first thread and said second-thread are being spliced together.

19. A method, as claimed in claim 18, wherein:

said locating step includes moving a carriage assembly having a number of threads to cause lateral displacement of the first thread relative to said passageway of said splicing device.

20. A method, as claimed in claim 19, wherein:

said moving step includes causing said first thread to be positioned for trimming using a trimmer blade.

21. A method, as claimed in claim 18, wherein:

said trimming step includes moving a rocker to a first rocker position so that the first thread is positioned for trimming.

22. A method, as claimed in claim 21, wherein:

said-step of moving said rocker includes causing a portion of said first thread to be held in place using a thread clamp.

23. A method, as claimed in claim 21, wherein:

said step of moving said rocker includes causing a thread clamp cover to provide cutting engagement between a trimmer blade and the first thread.

24. A method, as claimed in claim 18, wherein:

said trimming step includes moving a rocker to a neutral position for causing a thread clamp cover to lift away from a trimmer blade and a thread clamp to hold the end of the first thread.

25. A method, as claimed in claim 18, wherein:

said trimming step includes rotating a thread insertion roller to cause said first thread to be retracted away from a trimmer blade.

26. A method, as claimed in claim 18, wherein:

said locating step includes moving a carriage assembly having a number of holes including a second thread hole having said second thread therein relative to said passageway of said splicing device.

27. A method, as claimed in claim 26, wherein:

said step of moving said carriage assembly includes locating said second thread hole a distance past said splicing device passageway and then returning said second thread hole for alignment with said splicing device passageway.

28. A method, as claimed in claim 18, wherein:

said causing step includes contacting said second thread with a thread insertion roller.

29. A method, as claimed in claim 18, wherein:

said causing step includes creating a pressure differential in said splicing device tending to draw said second thread relative to said splicing unit.

30. A method, as claimed in claim 18, wherein:

said causing step includes metering a distance related to movement of said second thread relative to said splicing device.

31. A method, as claimed in claim 18, wherein:

said causing step includes moving an insertion drive roller and using air in drawing said second thread relative to said splicing device.

32. A method, as claimed in claim 18, wherein:

said splicing step includes moving a rocker to a second rocker position for clamping said first and second threads using a thread advance drive roller.

33. An apparatus for splicing a first thread with a second thread, comprising:

a thread tree for holding a plurality of spools of thread;

a splicing device for joining the first thread to the second thread, wherein the first thread and the second thread are each taken from a spool on said thread tree; and means for feeding the second thread to said splicing device so that the second thread can be joined to the first thread, said means for feeding includes an insertion roller disposed adjacent a first end of said splicing device and an advance roller positioned adjacent to a second end of said splicing device.

34. An apparatus as claimed in claim 33, further comprising:

a thread tensioner;

a take-up lever; and a reciprocating needle;

wherein said splicing device includes a splice chamber and a splice tube for injecting compressed air into said splice chamber; and wherein said means for feeding is located between said thread tree and said splicing device.

35. An apparatus, as claimed in claim 34, further comprising:

a thread select carriage, located between said thread tree and said means for feeding, and having a plurality of openings wherein, each opening can guide one thread; and a drive motor for moving said thread select carriage at right angles to an operating direction of said means for feeding so that one of said plurality of openings is in the operating path of said means for feeding.

36. An apparatus, as claimed in claim 35, further comprising:

a thread trimming device for cutting the first thread.

37. An apparatus, as claimed in claim 35, wherein:

said means for feeding includes means for gripping a thread projecting from said thread select carriage.

38. An apparatus for splicing a first thread with a second thread, comprising:

a thread tree having a number of spools with each having a thread and including at least a first spool having a first thread and a second spool having a second thread;

a thread clamp assembly for holding at least one of the first thread and the second thread;

a splicing device for splicing the first and second threads together;

a carriage assembly for locating the second thread selected from the number of threads in a desired position relative to said splicing device;

means for moving at least one of the first and second threads relative to said splicing device;

a needle thread trimming device for cutting the first thread, said thread trimming device including a thread clamp cover and a blade with said thread clamp cover being movable to position the first thread for cutting by said blade; wherein said thread clamp assembly, said means for moving and said thread trimming device are operatively interconnected to facilitate thread clamping, moving and trimming, said means for moving including a rocker and said thread clamp cover being connected to said rocker and being movable therewith, said thread clamp-assembly including a thread clamp and said thread trimming device including a shaft that connects said thread clamp cover to said rocker with said thread clamp cover being movable with said rocker while said thread clamp remains substantially stationary.

39. A method for splicing a first thread with a second thread, comprising:

providing a first thread;

locating a second thread in desired positions relative to a splicing device;

trimming said first thread to provide an end, said trimming step including rotating a thread insertion roller to cause said first thread to be retracted away from a trimmer blade;

causing said second thread to be positioned in a passageway of said splicing device; and splicing said first and second threads together using said splicing device after said trimming step.

40. A method for splicing a first thread with a second thread, comprising:

providing a first thread;

locating a second thread in desired positions relative to a splicing device;

trimming said first thread to provide an end;

causing said second thread to be positioned in a passageway of said splicing device, said causing step including contacting said second thread with a thread insertion roller; and splicing said first and second threads together using said splicing device after said trimming step.

41. A method for splicing a first thread with a second thread, comprising:

providing a first thread;

locating a second thread in desired positions relative to a splicing device;

trimming said first thread to provide an end;

causing said second thread to be positioned in a passageway of said splicing device, said causing step including moving an insertion drive roller and using air in drawing said second thread relative to said splicing device; and splicing said first and second threads together using said splicing device after said trimming step.

42. A method for splicing a first thread with a second thread, comprising:

providing a first thread;

locating a second thread in desired positions relative to a splicing device;

trimming said first thread to provide an end;

causing said second thread to be positioned in a passageway of said splicing device; and splicing said first and second threads together using said splicing device after said trimming step, said splicing step including moving a rocker to one rocker position for clamping said first and second threads using a thread advance drive roller.

* * * * *